US011639697B2

(12) United States Patent
Agnus et al.

(10) Patent No.: US 11,639,697 B2
(45) Date of Patent: May 2, 2023

(54) METHOD FOR CONTROLLING AN INTERNAL COMBUSTION ENGINE

(71) Applicant: VITESCO TECHNOLOGIES GMBH, Hanover (DE)

(72) Inventors: Yves Agnus, Toulouse (FR); Henri Mouisse, Toulouse (FR); Nicolas Loubet, Toulouse (FR)

(73) Assignee: VITESCO TECHNOLOGIES GMBH, Hanover (DE)

( * ) Notice: Subject to any disclaimer, the term of this patent is extended or adjusted under 35 U.S.C. 154(b) by 0 days.

(21) Appl. No.: 17/293,388

(22) PCT Filed: Nov. 13, 2019

(86) PCT No.: PCT/EP2019/081144
§ 371 (c)(1),
(2) Date: May 12, 2021

(87) PCT Pub. No.: WO2020/099469
PCT Pub. Date: May 22, 2020

(65) Prior Publication Data

US 2021/0388794 A1 Dec. 16, 2021

(30) Foreign Application Priority Data

Nov. 14, 2018 (FR) ..... 1860496

(51) Int. Cl.
*F02D 41/38* (2006.01)

(52) U.S. Cl.
CPC .. *F02D 41/3845* (2013.01); *F02D 2200/0602* (2013.01); *F02D 2200/0625* (2013.01); *F02D 2200/101* (2013.01)

(58) Field of Classification Search
CPC ..... F02D 41/3845; F02D 2200/0602; F02D 2200/0625; F02D 2200/101
See application file for complete search history.

(56) References Cited

U.S. PATENT DOCUMENTS 5,012,780 A * 5/1991 Bugamelli ..... F02M 69/46 123/488
5,113,830 A * 5/1992 Haines ..... F02D 41/1498 123/436

(Continued)

FOREIGN PATENT DOCUMENTS

| | | |
|---|---|---|
| CN | 101040112 A | 9/2007 |
| JP | 10-30512 | 2/1998 |
| RU | 58 186 | 11/2006 |

OTHER PUBLICATIONS

International Search Report and Written Opinion of the ISA for PCT/EP2019/081144 dated Feb. 19, 2020, 13 pages.

(Continued)

*Primary Examiner* — Kurt Philip Liethen
(74) *Attorney, Agent, or Firm* — Nixon & Vanderhye

(57) ABSTRACT

A method for controlling an internal combustion engine controlled as a function of an operating-point setpoint, the method includes: determining whether a new operating-point setpoint is received, and if so determining the maximum capacity of the pump based on determined values of rotational speed of the engine, quantity of fuel injected, and fuel pressure in the common injection rail; determining fuel consumption flow rate; subtracting fuel consumption flow rate of the vehicle from the maximum capacity of the pump to obtain the remaining capacity of the fuel pump; determining the difference in fuel flow rate between the current operating point and the operating point of the new operating-point setpoint; and if the remaining capacity of the fuel pump is less than the difference in fuel flow rate, a reduced fuel flow rate gradient setpoint is emitted with the new operating-point setpoint or the quantity of fuel injected is limited.

12 Claims, 1 Drawing Sheet

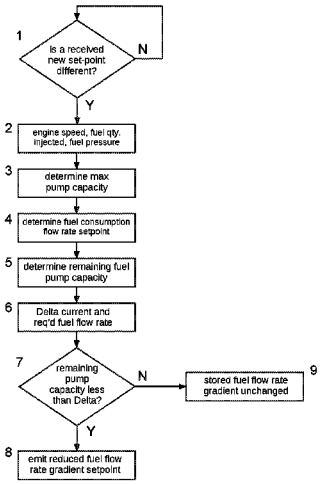

(56) References Cited

U.S. PATENT DOCUMENTS

| | | | | |
|---|---|---|---|---|
| 6,318,343 | B1 * | 11/2001 | Nakagawa | F02M 63/0225 123/90.15 |
| 7,703,435 | B2 * | 4/2010 | Surnilla | F02D 19/0615 123/304 |
| 8,276,566 | B2 | 10/2012 | Horstmann et al. | |
| 9,856,837 | B2 * | 1/2018 | Dunn | F02D 41/0025 |
| 2003/0233998 | A1 * | 12/2003 | Futonagane | F02D 41/403 123/299 |
| 2008/0216797 | A1 | 9/2008 | Oono | |
| 2012/0215422 | A1 | 8/2012 | Sugiyama et al. | |
| 2014/0224221 | A1 | 8/2014 | Kees et al. | |
| 2014/0373816 | A1 * | 12/2014 | Nagar | F02D 41/0072 123/51 B |
| 2017/0224221 | A1 | 8/2017 | Matsumoto | |
| 2018/0328307 | A1 * | 11/2018 | Kurtz | F02D 41/403 |

OTHER PUBLICATIONS

Office Action issued in Chinese Patent Application No. 201980074943.X, dated Oct. 18, 2022.

* cited by examiner

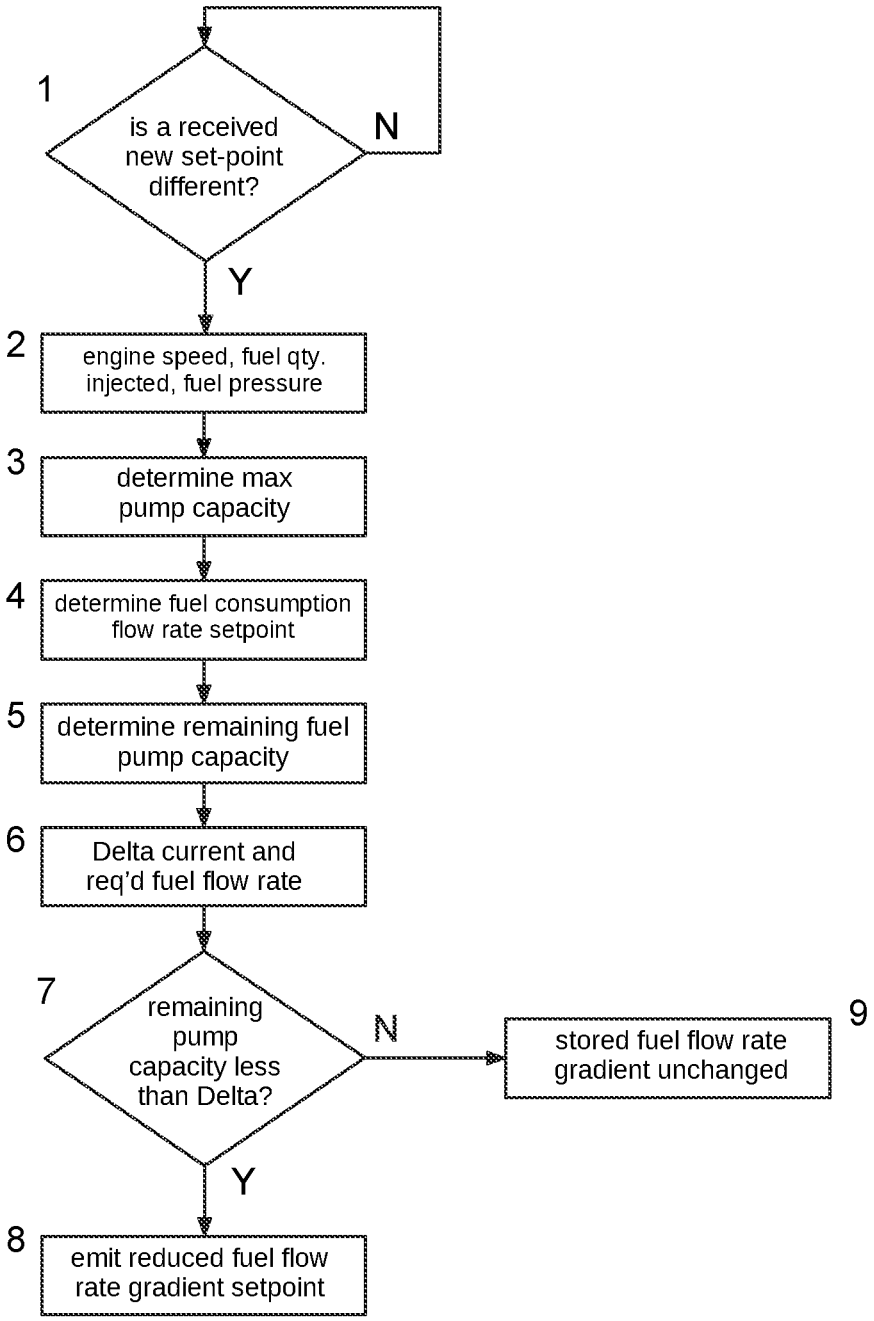
1
is a received new set-point different?
N
Y
2
engine speed, fuel qty. injected, fuel pressure
3
determine max pump capacity
4
determine fuel consumption flow rate setpoint
5
determine remaining fuel pump capacity
6
Delta current and req'd fuel flow rate
7
remaining pump capacity less than Delta?
N
9
stored fuel flow rate gradient unchanged
Y
8
emit reduced fuel flow rate gradient setpoint

METHOD FOR CONTROLLING AN INTERNAL COMBUSTION ENGINE

This application is the U.S. national phase of International Application No. PCT/EP2019/081144 filed Nov. 13, 2019 which designated the U.S. and claims priority to FR Patent Application No. 1860496 filed Nov. 14, 2018, the entire contents of each of which are hereby incorporated by reference.

BACKGROUND OF THE INVENTION

Field of the Invention

The technical field of the invention is the control of an internal combustion engine, and more precisely the control of the fuel pump of such an engine.

Description of the Related Art

An internal combustion engine comprises injectors supplied with fuel by a common injection rail, the pressure and fuel intake of which are regulated by a fuel pump. The fuel pump is driven by the internal combustion engine and is sized according to the operating points of the engine, in particular according to the performance of the engine. On the other hand, the mechanical driving stresses require a controlled resistive torque of the pump.

For each engine, a pressure gradient is specified which must be able to be achieved by the fuel pump so that the pressure in the common injection rail changes as a function of the engine operating points within predetermined times.

Likewise, diagnostic systems are required to monitor pump activity and emit an error signal when the required pressure is not reached within a predetermined time. This implies that the pressure in the common injection rail varies more slowly than expected to reach a setpoint value. It is then considered that there is a fault with the fuel pump.

It appears that most of the capacities of the fuel pump are used from the low speeds of rotation of the internal combustion engine (N<2000 rpm). Moreover, during transient phases linked to certain particular operating cases (antipollution regeneration, etc.), an additional fuel flow rate compared with the fuel flow rate required for the current operating point may be necessary. Depending on the amount of the additional flow rate required, the fuel pump may not be able to deliver the specified pressure gradient. On the other hand, the reuse of existing engines associated with new pollution control standards and the performance levels desired by the motorist constrain the volumes pumped and exacerbate the problem.

The diagnostic systems then emit an error signal when the pump is not malfunctioning but has simply reached its maximum capacities.

There is thus a technical problem relating to the false detection of errors linked to the fuel pump during transient speeds.

SUMMARY OF THE INVENTION

The subject of the invention is a method for controlling an internal combustion engine provided with fuel injectors connected to a fuel supply rail supplied with fuel by a fuel pump, the internal combustion engine being controlled as a function of an operating-point setpoint. The method comprises the following steps:

it is determined whether a new operating-point setpoint different from the current operating-point setpoint is received, if this is the case, the maximum capacity of the pump is determined as a function of determined values of the speed of rotation of the internal combustion engine, of the quantity of fuel injected and of the fuel pressure in the common injection rail, the fuel consumption flow rate of the vehicle is determined, the fuel consumption flow rate of the vehicle is subtracted from the maximum capacity of the pump in order to obtain the remaining capacity of the fuel pump, the difference in fuel flow rate between the current operating point and the operating point of the new operating-point setpoint is determined, if the remaining capacity of the fuel pump is less than the difference in fuel flow rate, a reduced fuel flow rate gradient setpoint is emitted with the new operating-point setpoint or the quantity of fuel injected is limited.

The reduced fuel flow rate gradient setpoint may be equal to a stored value.

The reduced fuel flow rate gradient setpoint can be determined as a function of the remaining capacity of the fuel pump and of the dimensions of the common injection rail, of the fuel supply lines between the rail and the injectors, of the fuel supply lines between the fuel pump and the rail, and of the high-pressure volumes in the injectors and in the fuel pump.

The reduced fuel flow rate gradient setpoint can be applied for a predetermined period.

The reduced fuel flow rate gradient setpoint can be applied for a period depending on the ratio between the stored fuel flow rate gradient and the reduced fuel flow rate gradient.

The reduced fuel flow rate gradient setpoint can be applied until the next operating-point setpoint is received.

Such a control method makes it possible to limit the overall performance of an engine to cover specific operating cases such as the regeneration of the particulate filter.

The control method makes it possible to equip an engine with a fuel pump capable of responding to the system consumption but at under-capacity for specific operating cases.

The method obviously makes it possible to respond to the technical problem by suppressing the error signals from the fuel pump linked to the under-capacity of the pump in specific operating cases.

Other aims, features and advantages of the invention will become apparent on reading the following description, given solely by way of nonlimiting example and with reference to the appended drawings, in which the single FIGURE illustrates the main steps of the control method according to the invention.

BRIEF DESCRIPTION OF THE DRAWING

The single FIGURE shows the main steps of a method for controlling an internal combustion engine provided with fuel injectors connected to a fuel supply rail supplied with fuel by a fuel pump.

DESCRIPTION OF THE PREFERRED EMBODIMENTS

During a first step 1, it is determined whether a new operating-point setpoint different from the current operating-point setpoint is received. If this is not the case, the method returns to the first step 1. If this is the case, the method continues with a second step 2.

During a second step 2, the speed of rotation N of the internal combustion engine, the quantity of fuel injected MF and the fuel pressure PFU in the common injection rail are determined.

During a third step 3, the maximum capacity Max_capa_pompe of the pump is determined as a function of the speed of rotation N of the internal combustion engine, the quantity of fuel injected MF and the fuel pressure PFU in the common injection rail. For this, a map of the flow rate of the pump is used as a function of the pressure and of the flow rate required and also as a function of the speed of rotation. It will be understood that the pressure and the required flow rate of the pump correspond respectively to the fuel pressure PFU in the common injection rail and to the quantity of fuel injected MF, while the speed of rotation depends on the speed of rotation N of the internal combustion engine.

During a fourth step 4, the fuel consumption flow rate setpoint of the vehicle Sys_conso is determined in the form of a flow rate. To determine this, the consumption of the internal combustion engine and, optionally, of the other fuel-consuming systems, such as a pollution control or particulate filter regeneration system, are summed.

During a fifth step 5, the fuel consumption flow rate setpoint of the vehicle Sys_conso is subtracted from the maximum capacity Max_capa_pompe of the pump in order to obtain the remaining capacity of the fuel pump Delta_capa_pompe.

During a sixth step 6, the difference Delta_cons_MF in fuel flow rate between the current operating point and the required operating point when changing the operating setpoint is determined. The difference Delta_cons_MF corresponds to the sum of the fuel consumption flow rate setpoint of the vehicle Sys_conso and of the volume of fuel to be added to the common rail in order to reach the target pressure setpoint in the rail. The volume of fuel to be added is calculated from the volume of the elements comprising high-pressure fuel and from the compressibility of the fuel as a function of the nature of the fuel, of its temperature and of its pressure.

The volume of the elements comprising high-pressure fuel is equal to the sum of the volume of the common injection rail, of the fuel supply lines between the rail and the injectors and of the fuel supply lines between the fuel pump and the rail, and of the high-pressure volumes in the injectors and in the fuel pump.

During a seventh step 7, the remaining capacity of the fuel pump Delta_capa_pompe is compared with the difference Delta_cons_MF in fuel flow rate.

If the remaining capacity of the fuel pump Delta_capa_pompe is less than the difference Delta_cons_MF in fuel flow rate, during an eighth step 8, a reduced fuel flow rate gradient setpoint is emitted with the new operating-point setpoint.

If this is not the case, the method continues during a ninth step 9 during which the new operating-point setpoint is emitted without modifying the stored fuel flow rate gradient.

The reduced fuel flow rate gradient setpoint may be equal to a stored value.

The reduced fuel flow rate gradient setpoint can be determined as a function of the remaining capacity of the fuel pump Delta_capa_pompe and of the dimensions of the volume of the elements comprising high-pressure fuel and of the compressibility of the fuel.

In one embodiment, the reduced fuel flow rate gradient setpoint is applied for a predetermined period.

In one particular embodiment, the reduced fuel flow rate gradient setpoint is applied for a period depending on the ratio between the stored fuel flow rate gradient and the reduced fuel flow rate gradient.

In an alternative embodiment, the reduced fuel flow rate gradient setpoint is applied until the next operating-point setpoint is received.

In an alternative embodiment, the quantity of fuel injected is limited.

The invention claimed is:

1. A method for controlling an internal combustion engine provided with fuel injectors connected to a common fuel supply rail supplied with fuel by a fuel pump, the internal combustion engine being controlled as a function of an operating-point setpoint, the method comprising the following steps:

receiving a new operating-point setpoint;

determining that the new operating-point setpoint is different from a current operating-point setpoint, and determining a maximum capacity of the fuel pump as a function of determined values of a speed of rotation of the internal combustion engine, a quantity of fuel injected, and a fuel pressure in the common fuel supply rail;

determining a fuel consumption flow rate of the vehicle;

calculating a remaining capacity of the fuel pump by subtracting the fuel consumption flow rate of the vehicle from the maximum capacity of the fuel pump;

determining a difference in fuel flow rate between a current operating point and an operating point of the new operating-point setpoint; and determining that the remaining capacity of the fuel pump is less than the difference in fuel flow rate, and either of i) limiting the quantity of fuel injected or ii) emitting a reduced fuel flow rate gradient setpoint with the new operating-point setpoint.

2. The control method as claimed in claim 1, wherein the reduced fuel flow rate gradient setpoint is equal to a stored value.

3. The control method as claimed in claim 1, wherein the reduced fuel flow rate gradient setpoint is determined as a function of the remaining capacity of the fuel pump, and of dimensions of the common fuel supply rail, of fuel supply lines between the common fuel supply rail and the injectors, of fuel supply lines between the fuel pump and the common fuel supply rail, and of high-pressure volumes in the injectors and in the fuel pump.

4. The control method as claimed in claim 1, wherein the reduced fuel flow rate gradient setpoint is applied for a predetermined period.

5. The control method as claimed in claim 1, wherein the reduced fuel flow rate gradient setpoint is applied for a period depending on a ratio between a stored fuel flow rate gradient and the reduced fuel flow rate gradient.

6. The control method as claimed in claim 1, wherein the reduced fuel flow rate gradient setpoint is applied until a next operating-point setpoint is received.

7. The control method as claimed in claim 2, wherein the reduced fuel flow rate gradient setpoint is applied for a predetermined period.

8. The control method as claimed in claim 3, wherein the reduced fuel flow rate gradient setpoint is applied for a predetermined period.

9. The control method as claimed in claim 2, wherein the reduced fuel flow rate gradient setpoint is applied for a period depending on a ratio between a stored fuel flow rate gradient and the reduced fuel flow rate gradient.

10. The control method as claimed in claim 3, wherein the reduced fuel flow rate gradient setpoint is applied for a period depending on a ratio between a stored fuel flow rate gradient and the reduced fuel flow rate gradient.

11. The control method as claimed in claim 2, wherein the reduced fuel flow rate gradient setpoint is applied until a next operating-point setpoint is received.

12. The control method as claimed in claim 3, wherein the reduced fuel flow rate gradient setpoint is applied until a next operating-point setpoint is received.

* * * * *